US005765941A

United States Patent [19]

Vest

[11] Patent Number: 5,765,941

[45] Date of Patent: Jun. 16, 1998

[54] FLUORESCENT LAMP AND METHOD OF MANUFACTURING SAME

[75] Inventor: Gary W. Vest, Cleveland, Ohio

[73] Assignee: Central Tools, Inc., Cranston, R.I.

[21] Appl. No.: 600,205

[22] Filed: Feb. 12, 1996

Related U.S. Application Data

[63] Continuation-in-part of Ser. No. 93,211, Jul. 16, 1993, abandoned.

[51] Int. Cl.[6] ..... F21V 15/04

[52] U.S. Cl. ..... 362/260; 362/223; 362/390; 362/294; 362/306; 313/50

[58] Field of Search ..... 362/221, 222, 362/223, 226, 260, 263, 265, 267, 306, 375, 376, 377, 378, 380, 369, 294; 313/50

[56] References Cited

U.S. PATENT DOCUMENTS

| | | | |
|---|---|---|---|
| D. 335,756 | 5/1993 | Gaynor . | |
| 2,320,170 | 5/1943 | Bishop et al. | 313/50 X |
| 2,904,617 | 9/1959 | King . | |
| 3,706,902 | 12/1972 | Cookson . | |
| 4,112,485 | 9/1978 | Sutter | 362/390 |
| 4,312,028 | 1/1982 | Hamacher | 362/369 |
| 4,538,217 | 8/1985 | Ewing et al. | 362/375 |
| 4,908,546 | 3/1990 | Shaffer et al. . | |
| 4,939,863 | 7/1990 | Alexander et al. | 362/369 |
| 5,117,345 | 5/1992 | Baake | 362/390 |
| 5,153,480 | 10/1992 | Schoenherr et al. . | |
| 5,299,110 | 3/1994 | Lin | 362/390 |
| 5,301,093 | 4/1994 | Baggio | 362/223 |

OTHER PUBLICATIONS

New Era Products, Inc. information sheet for *Professional Mechanic's Rough Service Fluorescent Utility Lights* (undated).

*Primary Examiner*—Thomas M. Sember
*Attorney, Agent, or Firm*—Lackenbach Siegel Marzullo Aronson & Greenspan, PC

[57] ABSTRACT

A portable work light having a fluorescent lamp (fluorescent light bulb). The fluorescent lamp has a base which supports a translucent envelope that contains a gas for emitting light when energized by an electric input. Activation circuitry is contained within a base housing, as is a portion of the translucent envelope. A flexible, electrically and mechanically insulating material is injected into the base housing to stabilize and prevent movement of the actuation circuitry with respect to the base housing and translucent envelope, thereby preventing damage to the components of the fluorescent lamp. The portable work light has a transparent cover which supports a lamp. The cover has electrical connectors at one end for engaging the lamp. The cover has a bulb support mechanism which engages a lip on the base of a lamp to maintain the electrical contact of the lamp engaged with the electrical connectors and to inhibit movement of the base of the lamp relative to the cover. The portable work light has and end support which engages a lamp at a location away from the base, to resist movement of the end portion of the lamp relative to the cover.

15 Claims, 4 Drawing Sheets

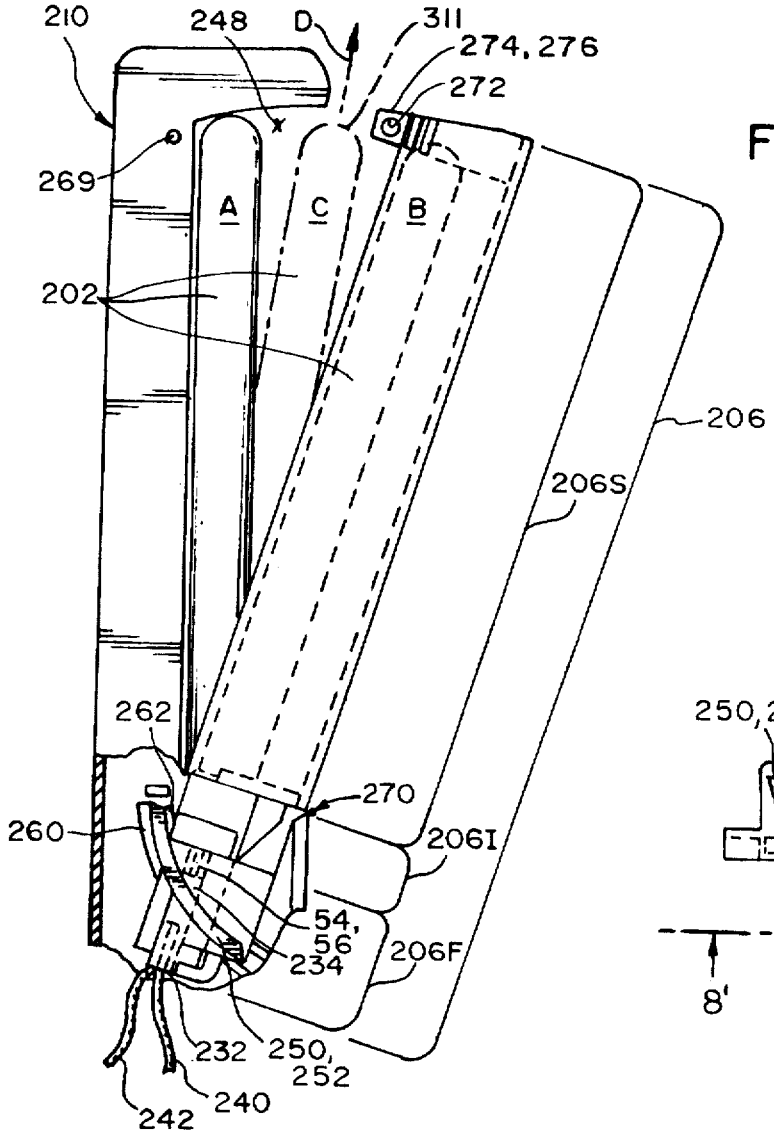
FIG. 6'
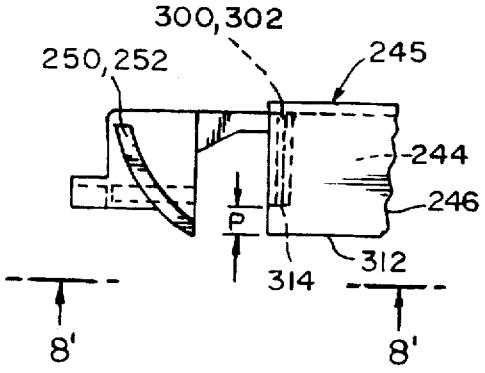
FIG. 7'
FIG. 9'
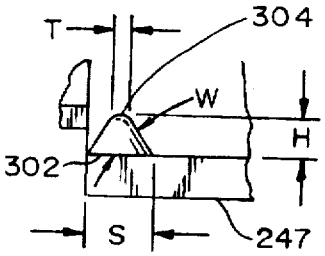
FIG. 8'
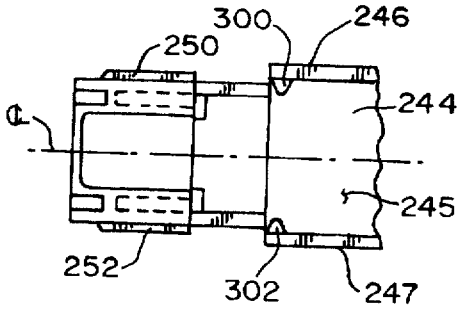

FLUORESCENT LAMP AND METHOD OF MANUFACTURING SAME

CROSS REFERENCE TO RELATED APPLICATION

This is Continuation-in-Part of application Ser. No. 08/093,211 filed on Jul. 16, 1993, now abandoned.

FIELD OF THE INVENTION

The present invention concerns a portable work light having a fluorescent light bulb (hereinafter referred to as a fluorescent lamp), a method for producing a component stabilized fluorescent lamp for mobile or portable applications, and an improved bulb support in a protable work light.

BACKGROUND ART

Fluorescent lamps have in the past been used in handheld portable work lights. Such work lights are moveable to a work site by extending a power cord from an electrical outlet to the work light and typically hanging the work light from a hanger. Numerous model work lights containing fluorescent lamps have been made and sold by New Era Products Inc. of Cleveland, Ohio, including models 190-25 and 130-25. Fluorescent lamps used in work lights have in the past, experienced high failure rates due to the moveable nature of the work light, and the rough service those work lights receive as a result of this mobile, portable feature.

A fluorescent lamp is a type of low-pressure mercury discharge lamp. A discharge arc operates within a translucent tube usually made of glass, containing mercury vapor and coated on the inside with phosphor powder. The electric discharge arc ionizes the gas which then subsequently produces blue, green and ultraviolet radiation. The phosphor coating on the translucent envelope converts this to visible light by a process called phosphorescence.

Fluorescent lamps commonly use a starter circuit which initiates an electric discharge arc within the translucent tube containing a light emitting gas. The starter circuit often includes a ballast device for generating an appropriate voltage for generating a discharge arc within the gas filled translucent tube, while limiting the electric current in the circuit. The starter circuit also often contains a switching element, such as a heat sensitive switch, which can electrically connect the lamp preheat filaments to the circuit containing the ballast device. This heat sensitive switch is often generically called a "starter" or "starter glow switch", and may also be combined with a radio frequency suppression device, such as a capacitor.

Compact fluorescent lamps are a type of fluorescent lamp in which the translucent envelope containing a light emitting gas is folded into a U-shape. With both ends of the discharge path in close proximity, the two end caps of an otherwise linear lamp are combined into a single unit. This single unit end cap on a compact fluorescent lamp is called a base. The base provides support structure for the gas filled translucent envelope, and contains conductors for providing electric power to electrodes contained in the translucent envelope.

Commonly, certain types of compact fluorescent lamps contain components of the starting circuit, and also enclose these components within an enclosure contained within the physical structure of the base. These components are often a heat sensitive switch, a radio frequency suppression device, and electrical conductors with which to connect these components to the gas filled translucent envelope.

When power is applied to an electrical apparatus, such as a portable work light, which contains a fluorescent lamp, a gas inside the heat sensitive switch generates heat. When sufficient heat is generated, a threshold temperature is reached. At this temperature, contacts inside the heat sensitive switch close, providing a low impedance electric current path which includes the ballast device, and filaments inside the translucent envelope of the discharge arc tube. When the contacts within the heat sensitive switch open, the current flow through the ballast device is interrupted. The subsequent collapsing magnetic field within the ballast device induces a relatively large voltage. This voltage is applied to the gas filled translucent envelope which comprises a discharge arc tube, by means of conductors coupled to the filaments. The high voltage produces an electric arc within the gas filled discharge arc tube, lowering the internal impedance such that a sustained electric current can flow through the gas. The current flowing through the gas causes light to be emitted, and the current flow is limited by the ballast device.

This entire structure, comprising:

(i) a discharge arc tube consisting of a translucent envelope folded into a U-shape and containing a gas which, when energized via filament electrodes, emits light;

(ii) a base which provides structural support for the discharge arc tube and contains electrical connectors for applying electrical power to the arc tube, and defining an enclosure, which may contain;

(iii) a heat sensitive switch and;

(iv) a capacitor, both electrically connected to filament electrodes within the arc tube;

describe an entity commonly referred to as a compact fluorescent light bulb or compact fluorescent lamp. These fluorescent lamps are commercially available from a variety of manufacturers in a variety of models classified by wattage rating.

Fluorescent lamps have typically been predominantly used in stationary applications. Physical damage to the fluorescent lamp is a major cause of fluorescent lamp failure in portable work lights, which then require replacing the fluorescent lamp. The physical damage to the fluorescent lamp is brought about by conditions associated with the mobile, portable nature of the work lights. Physical damage can be attributed to the unwanted and destructive motion of the internal, integral components of a fluorescent lamp with respect to other internal components of that fluorescent lamp. To avoid this damage, a way to stabilize and prevent movement of the internal, integral components of a fluorescent lamp is needed.

It is an object of the present to solve these and other problems encountered in the art.

DISCLOSURE OF THE INVENTION

Fluorescent light apparatus constructed in accordance with the invention includes a bulb that encloses an ionizable gaseous for emitting light. An input circuit supplies energy to start and sustain a gas discharge. A base supports the bulb and encloses the input circuit within a base housing interior. Flexible insulating material within the base housing interior contacts a portion of the bulb extending into the housing interior and dampens vibrations that otherwise might be transmitted from the base housing to the portion of the bulb extending into the housing interior.

Testing of fluorescent light bulbs constructed in accordance with the invention has resulted in less failure due to bulb breakage. There is also less chance that the components that make up the input circuit can move within the bases housing so there is less chance of failure of the input circuit. When used in a work lamp, fluorescent bulbs constructed in accordance with the invention are longer lasting and can better withstand the rough service such lamps receive.

A work lamp embodying the invention includes a light bulb. The light bulb has a base that supports an electrical contact at one end of the light bulb. A lip is formed in the base at a location between the contact and another end of the light bulb. A transparent cover supports the light bulb. The cover includes a connector for engaging and conducting electrical power to the light bulb contact. The cover has a support for engaging the lip on the base of the light bulb to resist movement of the light bulb relative to the cover and to maintain engagement between the cover connector and light bulb contact. The work lamp also includes a resilient support engaging a portion of the light bulb between the base and the other end to resist movement of that portion of the light bulb relative to the cover.

These and other features of the invention will be better understood from the description of the preferred embodiment which is described in conjunction with the accompanying drawings.

BRIEF DESCRIPTION OF THE DRAWINGS

FIG. 6' is an enlarged view of a portion of the assembled work lamp in FIG. 5' with parts illustrated in different positions;

FIG. 7' is an enlarged view of a portion of a cover in FIG. 6';

FIG. 8' is a view of the portion of the cover in FIG. 7', taken along line 8—8 in FIG. 7'; and FIG. 9' is an enlarged view of a bulb support portion of the cover in FIG. 8'.

BEST MODE FOR PRACTICING THE INVENTION

Figure 2:
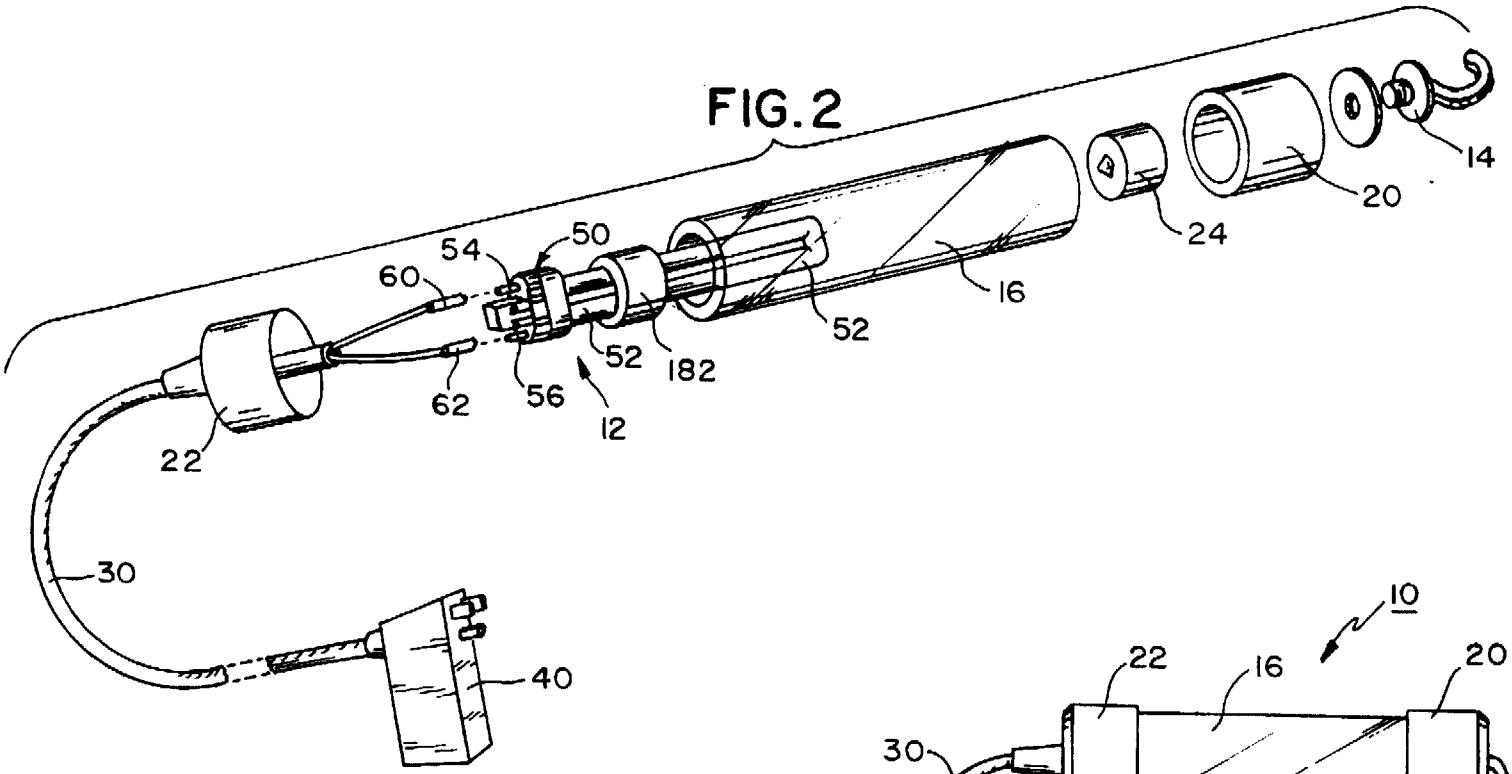
FIG. 2 is an exploded perspective view of the FIG. 1 work lamp.
Figure 1:
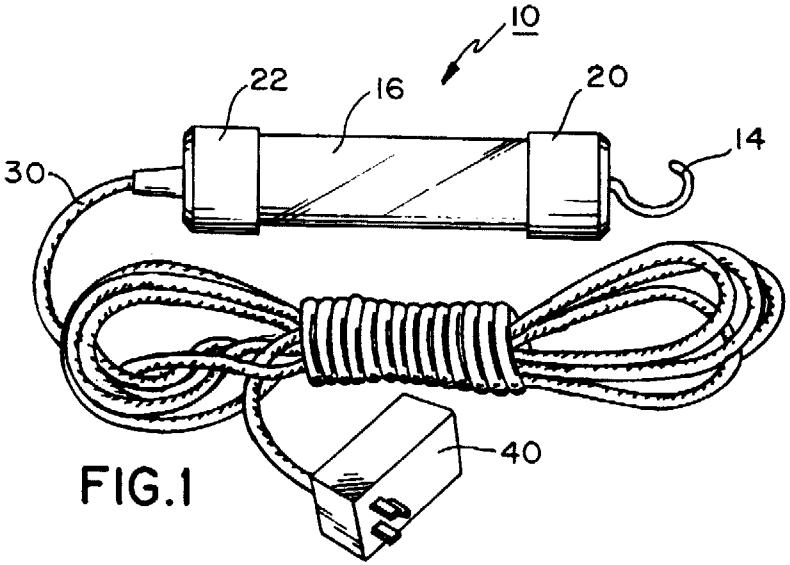
FIG. 1 is a perspective view showing a work lamp having a fluorescent light bulb.

Turning now to the drawings, FIGS. 1 and 2 show a work lamp 10 including a fluorescent light bulb 12 that emits light from the work lamp. The bulb 12 is user replaceable. The work lamp 10 includes a hanger 14 for supporting the work lamp at a work location. The hanger 14 supports an elongated tubular shaped plastic lens 16 which is transparent and closed at its ends by flexible plastic end caps 20, 22.

The cap 20 has an opening through which a threaded end portion of the hanger 14 extends into threaded engagement with a nut member 24. The cap 22 includes an opening to accommodate an electrical power cord 30 of a sufficient length to be routed from an electrical outlet to a work area. At one end of the cord 30 is located a ballast 40 containing electrical components to convert the 110 volt AC output from the electrical outlet into a suitable alternating current signal of a reduced voltage for energizing the fluorescent bulb 12. Ballasts for such purposes are well known in the art. Connectors 60, 62 are located at the other end of the cord 30.

The bulb 12 (FIGS. 2 and 3) includes a base 50 that supports a U-shaped glass envelope 52 and electrical contacts 54, 56 which extend from the base. The contacts 54, 56 engage respective connectors 60, 62 of the electrical cord 30. The cord 30 carries AC power that has been stepped down from the 110 volt line voltage. To replace a bulb 12, the caps 20, 22 are separated from the lens 16 by pulling them axially away from the lens. The user can then pull the lens 16 away from the bulb 12 and disconnect the connectors 60, 62 from the contacts 54, 56. A new bulb 12 can be directly connected to the connectors 60, 62.

An improved fluorescent lamp constructed in accordance with the invention includes a translucent envelope enclosing a gas which, when energized, emits light and constituting an electric arc discharge tube. An input circuit to supply energy for starting and maintaining operation of the electric discharge arc tube. A base which supports the translucent envelope of the discharge arc tube and encloses components of the input circuit within a base housing interior. A flexible material which contacts the internal, integral components contained within the base interior and provides electrical and mechanical insulation between the components, providing stability of said components with regard to unwanted and damaging movement.

Testing of fluorescent lamps in accordance with the invention has resulted in less failure of fluorescent lamps due to physical damage. When used in a portable work light, fluorescent lamps constructed in accordance with the invention are longer lasting and can better withstand the rough service such portable work lights receive.

A work light embodying the invention includes a lamp (light bulb). The lamp has a base that supports a translucent envelope at one end, and electrical contacts at the other end. A lip is formed in the base at a location adjacent to the translucent envelope. A component of the electric lighting apparatus is a transparent cover, which is designed to support the lamp. The transparent cover includes a connector for engaging and conducting electric power to the lamp. The cover has a bulb support for engaging the lip on the base of the lamp to resist movement of the lamp relative to the cover and maintain engagement between the cover connector and the lamp contact. The electric lighting apparatus also includes a resilient end support engaging a portion of the lamp between the base and the other end to resist movement of that portion of the lamp relative to the cover. These and other features of the invention are better understood from the description of the preferred embodiment which is described in conjunction with the accompanying drawings.

Figure 4:
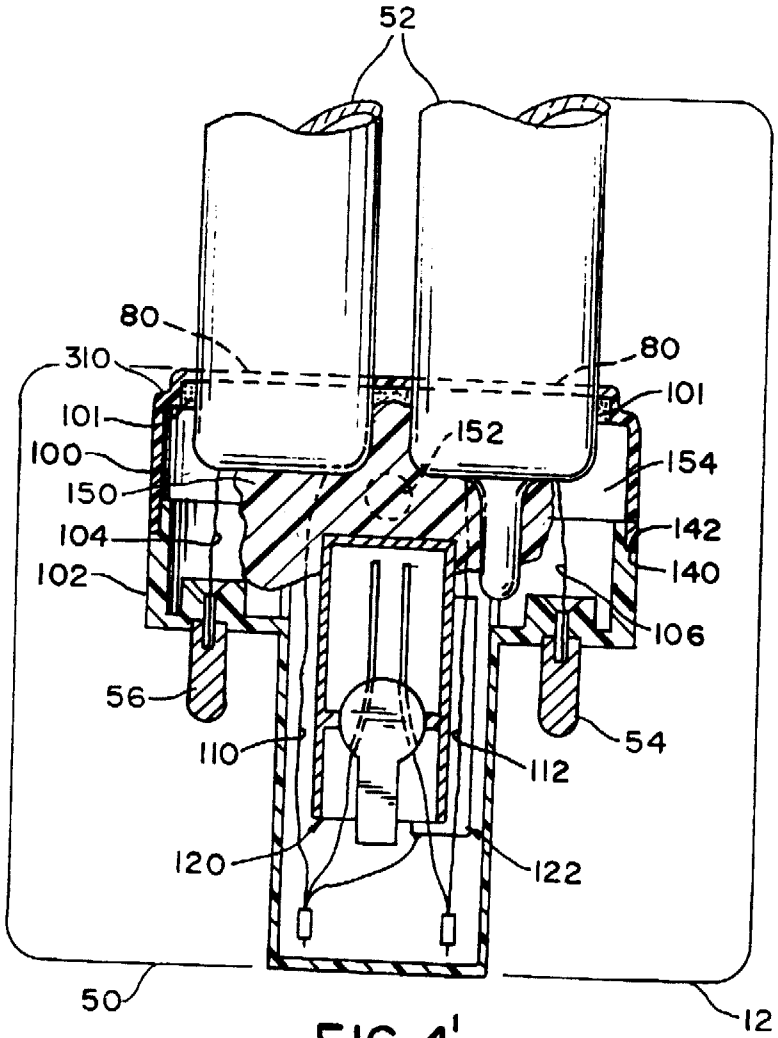
FIG. 4' is a section view showing the base after injection of a vibration insulating material into a housing interior.
Figure 3:
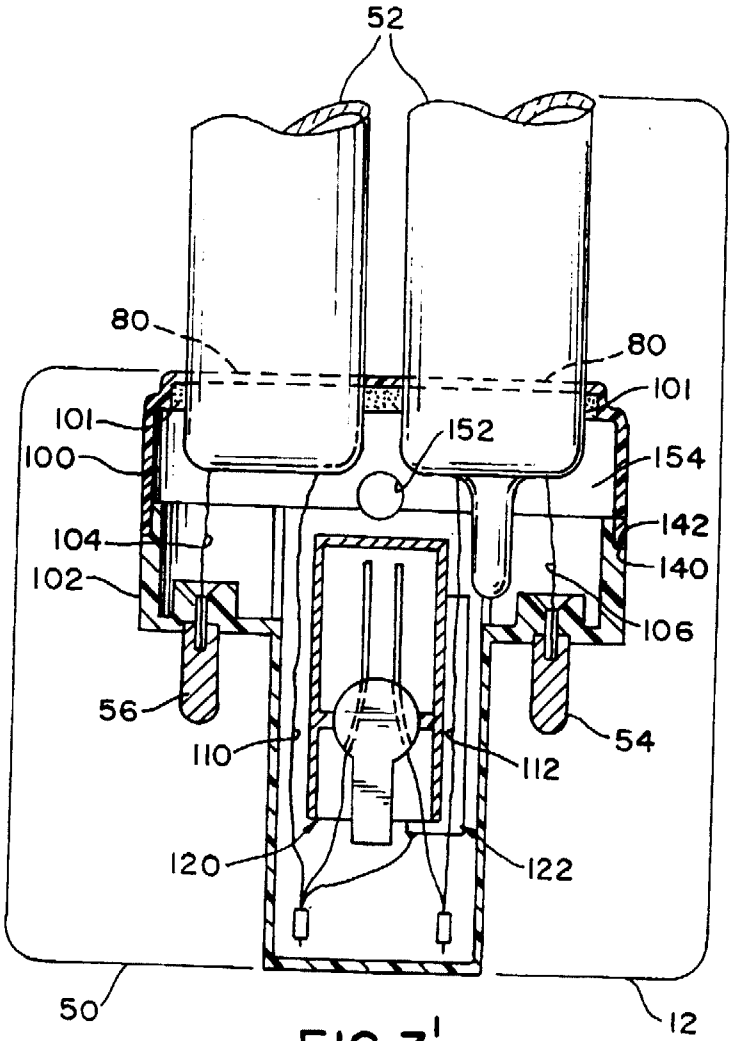
FIG. 3' is a partially sectioned view showing a base of the fluorescent light bulb.

Referring to FIGS. 3' and 4': the fluorescent lamp 12 includes a base 50 that supports a U-shaped translucent envelope 52 and electrical contacts 54, 56 which extend from the base. The section views of FIGS. 3 and 4 show engagement between the translucent envelope 52 of the fluorescent lamp 12 and the base 50 which supports the translucent envelope. The translucent envelope 52 is a generally U-shaped member having an evacuated interior into which an ionizable gas is injected through an opening in the translucent envelope. The opening in the translucent envelope 52 is sealed with a translucent bead on the extremity of one end of the U-shaped translucent envelope. During fabrication of the fluorescent lamp 12, the translucent envelope 52 is mounted to the base 50 by inserting the translucent envelope through holes 80 in a metal first base housing member 100 and applying a sealant 101 around the interface between the translucent envelope and the first base housing member. A plastic second base housing member 102 attaches to the first base housing member 100 to form the enclosed region within base 50 for supporting circuit components that activate the fluorescent lamp 12.

As seen in FIG. 3', the two contacts 54, 56 are electrically coupled to conductors 104 and 106 respectively, which extend into the translucent envelope 52 and contact filament elements (not shown) within the translucent envelope 52 which are heated during ignition of the fluorescent lamp 12. As also seen in FIG. 3' conductors 110, 112 electrically connected to the filament elements inside the translucent envelope 52 are routed from the translucent envelope to a glow starter switch 120 coupled in parallel with a capacitor 122. The glow starter switch 120 and capacitor 122 form circuit elements coupled in parallel across the filaments within the translucent envelope 52.

Figure 5:
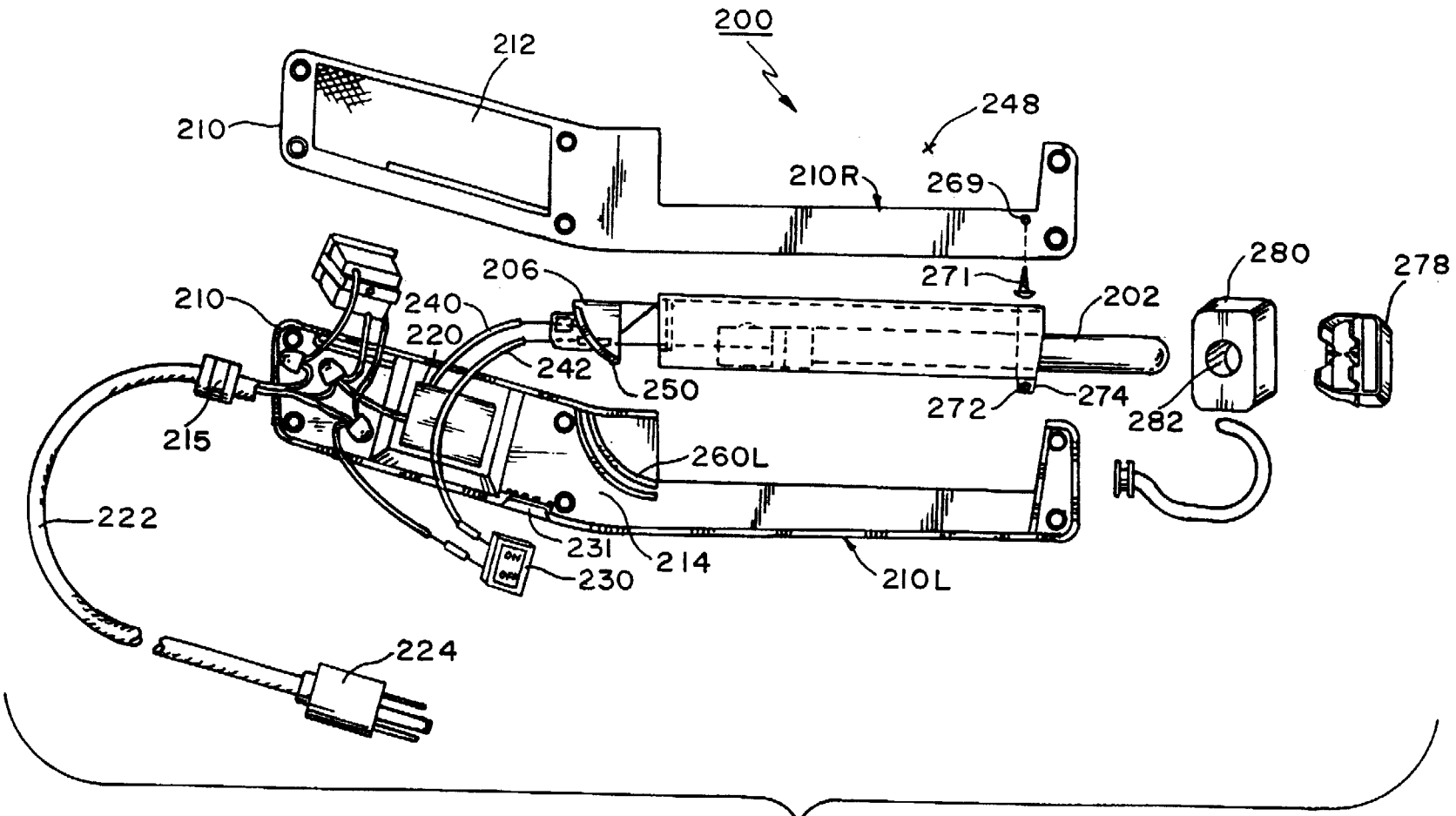
FIG. 5' is an exploded perspective view of an alternate work lamp.

When first energizing the fluorescent lamp 12, the electric current from the ballast 220 (FIG. 5') is coupled to a circuit including filaments inside the translucent envelope 52 and to the parallel combination of the glow starter switch 120 and capacitor 122. The glow starter switch 120 constitutes a heat sensitive electrical switch, with metal contacts which are open until a threshold temperature is reached. Electrical current passing through the filament elements within the translucent envelope 52 and an inert gas within the glow starter switch 120 cause the temperature within the glow starter switch to increase to the threshold temperature. This closes the initially open metal contacts within the glow starter switch 120 and supplies a current sufficient to generate appreciable heating of the filaments within the translucent envelope of the fluorescent lamp 12. When the electric current flows through the closed metal contacts of the glow starter switch 120 instead of the inert gas, the temperature of the glow starter switch decreases below the threshold temperature. Consequently, the metal contacts within the glow starter switch 120 open, causing a high voltage pulse to be applied to the filament elements in the translucent envelope 52 of the fluorescent lamp 12, from a ballast device 220 (FIG. 5'). This high voltage electric discharge causes an electric arc within the gas contained in the translucent envelope 52, causing light to be emitted and a drop in internal impedance of the gas. Once the fluorescent lamp 12 has been ignited, gas ionization and light emission will be maintained by the application of the electric current from the ballast 220 (FIG. 5') directly to the filament elements of the fluorescent lamp 12. The gas within the translucent envelope 52 will continue to emit light as long as the electrical output of the ballast 220 (FIG. 5') is coupled to the filament elements within the translucent envelope.

As seen in FIGS. 3' and 4', the first and second base housing members 100, 102 have end portions which engage each other about a perimeter of the end portions. The first base housing member 100 receives the translucent envelope 52 of the fluorescent lamp 12 and includes a bottom end seat 140 which engages a ledge 142 in the second base housing member 102. The first and second base housing members 100, 102 mate along this perimeter and enclose not only the glow starter switch 120 and capacitor 122, but also the ends of the U-shaped translucent envelope 52. Such a fluorescent lamp is a commercially available item manufactured and sold by: Osram Corporation in Montgomery, N.Y. under the trade names DULUX S, Double DULUX, and DULUX D; North American Phillips Lighting Corporation in Bloomfield, N.J. under the trade name PL and PL-C; and General Electric Lighting of Cleveland, Ohio under the trade name BIAX and Double BIAX (DULUX, PL and BIAX are registered trade names).

In order to make the portable work light 200 (FIG. 5') more resistant to damage from rough handling, a flexible electrical and mechanical insulating material 150 (FIG. 4'), for example silicone, is injected into the interior of the base 50 of the fluorescent lamp 12. To gain access to the interior of the base 50, a hole is drilled or punched through a planer wall 154 in the base. A sufficient amount of electrically and mechanically insulating material 150 is injected into the hole 152 in the base 50 to contact a portion of the glow starter switch 120, the capacitor 122 and translucent envelope 52 extending into the base 50. The electrically and mechanically insulating material 150 maintains the relative position of the glow starter switch 120, capacitor 122 and prevents contact with the base 50 and translucent envelope 52. After injection of the electrically and mechanically insulating material 150, the opening is closed with a tape that adheres to the exterior of the planer metal surface of the first base housing member 100 of the base 50.

Referring to FIG. 5': This is an exploded view of a portable work light 200 which includes a compact fluorescent lamp 202. The fluorescent lamp 202 emits light when energized from an electrical power source and the light is conveyed to a work area through a transparent and rigid lens or cover 206 that also supports the fluorescent lamp 202. The cover 206 and fluorescent lamp 202 are received in a plastic housing 210 having a grip portion 212. The housing 210 has two mirror image half portions 210L, 210R which are connected together by means of suitable threaded connectors extending through the half portions. The grip portion 212 of the housing 210 includes an interior region 214 for mounting a ballast device 220. An electrical cable 222 leading from an electrical plug 224 conducts 110 volts, 60 cycle alternating current to the ballast 220 mounted within the grip portion 212 of the housing 210. A strain relief bushing 216 retains the cable 222 in the housing 210. A switch 230 supported by the housing 210 in an opening 231 permits energizing the electric circuit containing ballast 220 and fluorescent lamp 202 causing light to be emitted from the portable work light 200.

The cap 278 is a relatively rigid molded plastic member. The cap 278 tightly fits in an axial end of the U-shaped channel 244 (FIG. 8') to provide some strength to resist excessive inward movement of the tabs 274, 276 towards one another. One end portion of the fluorescent lamp 202 fits within an opening 282 in the foam end support 280. The opening 282 in the foam end support 280 tightly fits around a portion of the translucent envelope 52 (FIG. 3') of the fluorescent lamp 202. The outer periphery of the foam end support 280 is sized to tightly fit within the cover 206 and the housing 210 when the cover is in a closed position relative to the housing. This tight fit of the foam end support 280 resists movement of the translucent envelope 52 (FIG. 3') of the fluorescent lamp 202 transversely relative to the cover 206 and housing 210.

U.S. Design Pat. No. Des335,756 to Gaynor discloses a similar appearing housing to the housing 210 of the portable work light 200 of FIG. 5'.

Referring to FIG. 6': The cover 206 is constructed from molded plastic and is generally transparent so that light generated by the fluorescent lamp 202 can pass through the cover 206 to the work area. At one end portion 206F the cover 206 includes passageways 232 that retain connectors 234 electrically connected to wires 240, 242 leading to the ballast 220 (FIG. 5') and switch 230 (FIG. 5'), respectively. These wires 240, 242 conduct electricity to energize the fluorescent lamp 202 in response to actuation of the switch 230 (FIG. 5'). At another and relatively larger end portion 206S, the cover 206 defines a U-shaped channel 244 (FIGS. 7' and 8') bounded by a base wall 245 (FIGS. 7' and 8') and side walls 246, 247 (FIGS. 7' and 8') into which the fluorescent lamp 202 is inserted during assembly of the portable work light 200 (FIG. 5'). The end portions 206F and 206S of the cover 206 are connected by an intermediate portion 206I. The fluorescent lamp 202, as previously described, includes contacts 54, 56 which are inserted into the connectors 234 in the cover 206.

Periodically, the fluorescent lamp 202 is replaced by pivoting the cover 206 and the fluorescent lamp 202 away from the opening 248 in the housing 210 to a relative orientation shown in FIG. 6'. The fluorescent lamp 202 pivots from a starting position A illustrated in solid lines to a pivoted position B illustrated in dashed lines with the cover 206. The cover 206 remains in the position illustrated in FIG. 6' while the fluorescent lamp 202 is pivoted to position C illustrated in solid lines between the cover 206 and the housing 210. The fluorescent lamp 202 is withdrawn from the channel 244 by moving in the direction indicated by arrow D and then replaced.

The cover 206 includes arcuate raised guides 250, 252 (FIGS. 6'–8') on opposite sides of one end portion 206F of the cover projecting from respective outer surfaces 254, 256 of the cover in the region of the connectors 234. These arcuate guides 250, 252 fit between and slidingly engage arcuate tracts 260, 262 (260R, 262R shown in FIG. 6) formed inside both half portions 210L, 210R (FIG. 5) of the housing 210. Engagement between the guides 250, 252 and tracts 260, 262 allows the cover 206 to pivot about a point location 270 and expose the fluorescent lamp 202 within the channel 244 for replacement of the fluorescent lamp. To replace the fluorescent lamp 202, the user pivots the cover 206 away from the in-use position A after pulling out two lock pins 271 (FIG. 5') which extend through holes 269 in the housing 210 into holes 272 in the two tabs 274, 276 of the cover 206. By exerting inward pressure against the two tabs 274, 276, the side walls 246, 247 of the cover 206 flex inward so the cover 206 can be pivoted about the pivot location 270 to expose the fluorescent lamp 202. A cap 278 (FIG. 5') and a resilient foam end support 280 (FIG. 5') are slid off the end of the fluorescent lamp 202 in position C, and the fluorescent lamp 202 grasped to exert an extraction force in a direction indicated by the arrow D which allows the contacts 54, 56 to be separated from the connectors 234 within the cover 206.

At the opposite end of the fluorescent lamp 202, the contacts 54, 56 are inserted into the connectors 234. The base 50 (FIG. 3') that supports the translucent envelope 52 (FIG. 3') of the fluorescent lamp 202 is pushed into the U-shaped channel 244 (FIG. 8') and engages two bulb supports 300, 302 (FIG. 8') formed in the plastic cover 206 and project inwardly from sides 246, 247, respectively. With the contacts 54, 56 fully seated within the connectors 234, the base 50 (FIG. 3') of the fluorescent lamp 202 rests against the bulb supports 300, 302 (FIG. 8') with a land 304 (FIG. 9') of each bulb support engaging a lip 310 (FIG. 4') in the base 50 (FIG. 4') of the fluorescent lamp 202. The lip 310 (FIG. 4') is formed around the entire periphery of the base 50 (FIG. 4') of the fluorescent lamp 202 at a location between the contacts 54, 56 and an axial end 311 of the translucent envelope 52 (FIG. 3') opposite the base 50 (FIG. 3'). This assures that the bulb supports 300, 302 (FIG. 8') are closer to the center of gravity of the fluorescent lamp 202 than a bulb support at a location, for example, axially outward from of the contacts 54, 56.

Referring to FIG. 7': The bulb supports 300, 302 extend along the inner surfaces of the walls 246, 247 (FIG. 8') from the bottom of the U-shaped channel 245 and end at a predetermined distance P from an end surface 312. The predetermined distance P is preferably 0.250 inch to locate the ends 314 of the bulb supports 300, 302 at about the midpoint of the extent of the smallest sides of the fluorescent lamp 202 (FIG. 5') when the fluorescent lamp is properly installed in the portable work light 200 (FIG. 5') and the cover 206 (FIG. 5') is closed. This relative location of the ends 314 assures that the bulb supports 300, 302 do not engage the lip 310 (FIG. 4') in the first base housing member 100 (FIG. 4') of the base 50 (FIG. 4) when the fluorescent lamp 202 (FIG. 6') is in the position C (FIG. 6') relative to the cover 206 (FIG. 6') to permit removal of the fluorescent lamp. The bulb supports 300, 302 engage the axial surface of the lip 310 (FIG. 4') of the first base housing member 100 (FIG. 4') to resist axial movement of the fluorescent lamp 202 (FIG. 6') relative to the cover 206 (FIG. 6') and maintain the contacts 54, 56 (FIG. 4') engaged with the connectors 234 (FIG. 6') in the cover (FIG. 6'). The bulb supports 300, 302 also engage the lateral surface of the lip 310 (FIG. 4') to resist transverse movement of the base 50 (FIG. 4') of the fluorescent lamp 202 (FIG. 6') relative to the cover 206 (FIG. 6').

Referring to FIG. 9': The bulb support 302 has a tip width T of about 0.031 inch. The height H of the bulb support 302 extending from the wall 247 is about 0.075 inch. The base width S of the bulb support 302 is about 0.135 inch. The angle W of the side walls of the bulb support 302 extending between the land 304 and the wall 247 is preferably 54 degrees. The combination of inwardly projecting bulb supports 300, 302 (FIG. 8') that engage the lip 310 (FIG. 4') in the first base housing member 100 (FIG. 4') of the base 50 (FIG. 4') of the fluorescent lamp 202 (FIG. 6') between the contacts 54, 56 (FIG. 4') and the opposite end of the fluorescent lamp 202 (FIG. 6') along with the foam support 280 (FIG. 5') which engages an end portion of the translucent envelope 52 (FIG. 3') of the fluorescent lamp 202 (FIG. 6') provide a retaining mechanism to the fluorescent lamp within the portable work light 200 (FIG. 5') to protect against damage due to excessive movement.

While the present invention has been described herein in some degree of particularity, it is to be understood that those of ordinary skill in the art may make certain additions or modifications to, or deletions from, the described present embodiment of the invention without departing from the spirit or the scope of the invention, as set forth in the appended claims.

We claim:

1. A work lamp apparatus comprising:

a light bulb for emitting light in response to activation by electrical power, said light bulb having a base that supports an electrical contact at one end of said light bulb, and a lip formed in said base at a location between said contact and another end of said light bulb;

power supply means for supplying electrical power to said electrical contact of said light bulb to activate said light bulb;

a housing having an interior region, said housing receiving said light bulb and a portion of said power supply means within said interior region; and a transparent cover supporting said light bulb, said cover including a connector for engaging said electrical contact of said light bulb and for conducting electrical power from said power supply means to said electrical contact, said cover having a bulb support for engaging said lip on said base of said light bulb to resist movement of said light bulb relative to said cover and maintain said electrical contact of said light bulb in engagement with said connectors; and said cover being movable relative to said housing from a closed position protecting said light bulb and an open position permitting access to and replacement of said light bulb.

2. The work lamp apparatus set forth in claim 1 further including arcuate guide means on said cover received in tract means in said housing enabling pivotal movement of said cover relative to said housing between a closed position and an open position.

3. The work lamp apparatus set forth in claim 1 further including support means engageable with a portion of said light bulb at a location away from said base to resist movement of the portion of said light bulb relative to said housing and said cover.

4. The work lamp apparatus set forth in claim 1 wherein said cover is elongated and has a U-shaped cross-section taken in a direction transverse to a longitudinal axis of said cover, said bulb support projecting from a side wall of said cover.

5. In an apparatus for supporting a light bulb in which the light bulb emits light in response to activation and has an electrical contact in a base at one end of the light bulb, wherein the improvement comprises:

a lip formed on the base of the light bulb at a location between the electrical contact and another end of the light bulb;

a cover for supporting the light bulb, said cover having a bulb support for engaging said lip of the light bulb to maintain the electrical contact of the light bulb engaged with an electrical connector and to inhibit movement of the base of the light bulb relative to said cover; and an end support engageable with an end portion of the light bulb at a location away from the base to resist movement of the end portion of the light bulb relative to said cover.

6. A cover for supporting a light bulb having a base with a contact at one end of the bulb and a lip formed in the base at a location between the contact and another end of the bulb, said cover comprising:

a first portion with a connector for engaging the contact of the bulb;

a second portion attached to said first portion for receiving at least a portion of the bulb therein, said second portion being formed into a U-shaped configuration having a pair of spaced apart side walls connected by a base wall; and a pair of bulb supports, each bulb support projects inwardly from a respective side wall towards the other bulb support to engage a portion of the lip in the base of the bulb on opposite sides to resist movement of the base of the bulb relative to said first portion.

7. A fluorescent lamp comprising:

a) a fluorescent tube defining an interior region into which an ionizing gas is introduced and including electrodes that ionize said gas;

b) a base housing supporting the fluorescent tube, the base housing defining an interior region into which an end of the fluorescent tube extends;

c) starter circuitry at least partially disposed within the base housing interior region for initiating a light-emitting gaseous discharge in the ionizing gas;

d) a flexible, vibration insulating material disposed within the interior region of the base housing that engages portions of the starter circuit and the fluorescent tube end extending into the housing to stabilize the starter circuitry within the base housing interior region and to reduce vibrations transmitted from the base housing to the fluorescent tube; and e) an electrical power conductor coupled to the starter circuitry and the fluorescent tube to initiate and maintain light-emitting gaseous discharge within the tube, said starter circuitry disposed within the interior region of the base housing including a heat sensitive switch.

8. The fluorescent lamp of claim 7 wherein the flexible, vibration insulating material is comprised of silicone.

9. The fluorescent lamp of claim 7 wherein the fluorescent tube includes a nipple at one end of the tube extending into the interior region of the base housing and further wherein the flexible, vibration insulating material disposed within the base housing interior region engages a portion of the nipple.

10. A fluorescent lighting apparatus containing:

a fluorescent lamp including a translucent envelope having ends and a housing enclosure which contains the ends of said translucent envelope, starting circuit component(s), and a radio frequency suppression device within said housing enclosure and cooperating with said lamp, insulating material being provided within said housing enclosure contacting and providing electrical and mechanical insulation between said starting circuit component(s), the ends of the translucent envelope and said radio frequency suppression device.

11. A fluorescent lamp of claim 10, wherein the flexible electrical and mechanical insulating material is silicone.

12. A fluorescent lighting apparatus containing:

a) a fluorescent lamp comprising:

(i) a translucent envelope, enclosing a gas that, when energized, emits light;

(ii) a base housing which supports said translucent envelope and defines an enclosure;

(iii) the end(s) of said translucent envelope extending into said base housing;

(iv) said base housing containing electrical conductors for inputting energy to start and sustain a discharge of light from the gas contained within the translucent envelope;

(v) said base housing also containing components of an electric lamp starting circuit for initiating the discharge of light from the gas contained in the translucent envelope;

(vi) said base housing also containing a radio frequency suppression device;

(vii) said base housing also containing a flexible material within the base housing, contacting and providing electrical and mechanical insulation between the body of the starting circuit component(s), the radio frequency suppression device, and the end(s) of the translucent envelope;

b) a power supply means to supply electrical power to said fluorescent lamp, to initiate and sustain a light emitting discharge; and c) a transparent covering means enclosing said fluorescent lamp including said base housing, to provide protection from damage.

13. A fluorescent lamp comprising:

a) a translucent envelope having ends, enclosing a gas that, when energized, emits light;

b) a base housing which supports said translucent envelope and defines an enclosure in which;

c) the end(s) of said translucent envelope extend into;

d) and said base housing contains electrical conductors for inputting energy to start and sustain a discharge of light from the gas contained within the translucent envelope;

e) and said base housing also contains components of an electric lamp starting circuit for initiating the discharge of light from the gas contained in the translucent envelope, such as a heat sensitive switch;

f) and contains a radio frequency suppression device, such as a capacitor;

g) and said base housing in addition contains a flexible material within the base housing, contacting and providing electrical and mechanical insulation between the body of the starting circuit component(s), said radio frequency suppression device, the components of the base housing, and the end(s) of the translucent envelope, to stabilize the electric lamp starter circuitry and radio frequency suppression device within the base housing enclosure interior region from external forces.

14. A fluorescent lamp of claim 13, wherein the flexible electrical and mechanical insulating material is silicone.

15. A fluorescent lighting apparatus comprising:

a) a fluorescent lamp comprising:

(i) a translucent envelope having ends, enclosing a gas that, when energized, emits light;

(ii) a base housing which supports said translucent envelope and defines an enclosure in which:

(iii) the end(s) of said translucent envelope extend into;

(iv) said base housing containing electrical conductors for inputting energy to start and sustain a discharge of light from the gas contained within the translucent envelope;

(v) and said base housing also contains components of an electric lamp starting circuit for initiating the discharge of light from the gas contained in the translucent envelope, such as a heat sensitive switch;

(vi) and contains a radio frequency suppression device, such as a capacitor, (vii) and said base housing in addition contains a flexible material within the base housing, contacting and providing electrical and mechanical insulation between the body of the starting circuit component (s), said frequency suppression device, the components of the base housing, and the end(s) of the translucent envelope, to stabilize the electric lamp starter circuitry and said radio frequency suppression device within the base housing enclosure interior region from external forces;

b) a power supply means to supply electrical power to said fluorescent lamp to initiate and sustain a light emitting discharge; and c) a transparent covering means enclosing said fluorescent lamp including said base housing enclosure, to provide protection from damage.

* * * * *